United States Patent [19]

Elliott et al.

[11] 4,376,462

[45] Mar. 15, 1983

[54] SUBSTANTIALLY SELF-POWERED METHOD AND APPARATUS FOR RECOVERING HYDROCARBONS FROM HYDROCARBON-CONTAINING SOLID HYDRATES

[75] Inventors: Guy R. B. Elliott, Los Alamos; Bruce L. Barraclough, Santa Fe; Nicholas E. Vanderborgh, Los Alamos, all of N. Mex.

[73] Assignee: The United States of America as represented by the United States Department of Energy, Washington, D.C.

[21] Appl. No.: 235,775

[22] Filed: Feb. 19, 1981

[51] Int. Cl.[3] ..... E21B 36/00; E21B 43/26; E21B 43/38

[52] U.S. Cl. ..... 166/267; 166/57; 166/265; 166/302; 166/308; 166/362; 166/DIG. 1

[58] Field of Search ..... 166/265, 267, 302, 303, 166/306, 371, 373, 362, 57, DIG. 1; 299/6

[56] References Cited

U.S. PATENT DOCUMENTS

| | | | |
|---|---|---|---|
| 1,140,982 | 5/1915 | Huff | 166/302 |
| 2,229,539 | 1/1941 | Zublin | 166/265 |
| 3,782,468 | 1/1974 | Kuwada | 166/267 |
| 4,007,787 | 2/1977 | Cottle | 166/267 |
| 4,090,564 | 5/1978 | Cook, Jr. et al. . | |
| 4,116,276 | 9/1978 | Cook, Jr. et al. . | |
| 4,131,161 | 12/1978 | Lacquement | 166/265 |
| 4,248,305 | 2/1981 | Scarbrough et al. | 166/306 X |
| 4,262,747 | 4/1981 | Elliot et al. | 166/265 X |

OTHER PUBLICATIONS

Linus Pauling, *College Chemistry*, W. H. Freeman and Co., 2nd edition, 1957, pp. 299–300.

W. J. Cieslewicz, "Some Technical Problems and Developments in Soviet Petroleum and Gas Production", *The Mines Magazine*, Nov. 1971, pp. 12–16.

Yu. F. Makogan, "Hydrates of Natural Gas", Geoexplorers Associates, Inc., 1978, pp. 103–157.

Gas Research Institute, Gas Hydrate Workshop, Denver, Colo., Feb. 1, 1979, pp. 41–42.

G. D. Holder et al., "Geological Implications of Gas Production From In-Situ Hydrates", Proceedings of the First Annual Symposium on Unconventional Gas Recovery, Pittsburgh, Pa., May 18–21, 1980, SPE Paper No. 8929, pp. 59–64.

*Primary Examiner*—James A. Leppink
*Assistant Examiner*—George A. Suchfield
*Attorney, Agent, or Firm*—Elizabeth O. Slade; Paul D. Gaetjens; Richard G. Besha

[57] ABSTRACT

A method and apparatus are provided for producing gaseous hydrocarbons from formations comprising solid hydrocarbon hydrates located under either a body of land or a body of water. The vast natural resources of such hydrocarbon hydrates can thus now be economically mined. Relatively warm brine or water is brought down from an elevation above that of the hydrates through a portion of the apparatus and passes in contact with the hydrates, thus melting them. The liquid then continues up another portion of the apparatus, carrying entrained hydrocarbon vapors in the form of bubbles, which can easily be separated from the liquid. After a short startup procedure, the process and apparatus are substantially self-powered.

13 Claims, 3 Drawing Figures

SUBSTANTIALLY SELF-POWERED METHOD AND APPARATUS FOR RECOVERING HYDROCARBONS FROM HYDROCARBON-CONTAINING SOLID HYDRATES

The invention is a result of a contract with the Department of Energy (Contract W-14 7405 -ENG-36).

BACKGROUND OF THE INVENTION

This invention relates generally to a method and apparatus for producing hydrocarbons from formations comprising hydrocarbon hydrates and relates more particularly to a substantially self-powered method and apparatus for such production.

Methane and other hydrocarbons are known to react with liquid water or ice to form solid compounds which contain both water and individual or mixed hydrocarbons. For example, if the methane pressure is 400 pounds per square inch (psi) and the water temperature is 32° F., then methane hydrate can form. Likewise, at 2000 psi and 60° F., the solid hydrate will form. For hydrocarbons to react with brine (defined herein as any solution based on a water solvent), as opposed to pure water, the methane pressures must be slightly higher at a given temperature; but in other ways the behavior is very similar. The hydrate compositions vary a little depending upon the conditions of formation, $CH_4.5.75H_2O$ and $C_3H_8.17H_2O$ being two compositions which can form. The hydrates are slightly less dense than ice.

Natural conditions suitable for the formation of solid hydrocarbon hydrates exist in a shell covering much of the earth which lies between about 1000 and a few thousand feet below the earth surface. However, at the earth surface the hydrocarbon pressure is too low for the hydrates to exist; and deep in the earth the geothermal gradient leads to temperatures too high for the hydrates to exist. On the ocean floor, the forming of a hydrate will yield an ice-like solid which will float up and be destroyed unless the material is anchored by a more dense material, for example mud or a porous formation (e.g., sandstone). However, near-freezing water or brine does exist widely below the earth surface beneath formations which will anchor the solid hydrates; and methane amd other gaseous hydrocarbons are constantly generated deeper in the earth as buried organic material is thermally decomposed as it sinks slowly into geothermal zones. Excellent conditions for formation of methane hydrate and other hydrates exist on muddy ocean floors where cold, dense brine settles at pressures over 400 psi and buried alluvial or deltaic material is generating methane. Sonic and other measurements suggest that very extensive hydrocarbon hydrate resources exist in the ocean depths off the coast of the eastern United States and elsewhere, often in the form of frozen muds which release their methane if they are heated.

Therefore, a very important problem today is how to recover natural gas economically from such hydrate formations.

Russian scientists have considered such hydrates, especially underground in the Siberian permafrost regions, as attractive sources of natural gas, (as disclosed in Yu. F. Makogon, "Hydrates of Natural Gas," Geoexplorers Associates, Inc., Denver, Col., 1978). That reference suggested (on page 155 ) decomposing such underground hydrates by heating the hydrate deposit from below the reservoir using geothermal waters. However, no details are given. And it is believed that they and others have not achieved either the method or apparatus of this invention for recovering hydrocarbons in a substantially self-powered manner.

Russian workers have reported that they have obtained methane from the underground hydrates by drilling into the hydrates and then injecting methanol or salts to melt the hydrates. See, for example, Yu. F. Makogan (cited above) at page 127. See also W. J. Cieslewicz, "Some Technical Problems and Developments in Soviet Petroleum and Gas Production", *The Mines Magazine,* Nov. 1971, pp. 12–16, at 15, where three methods of converting solid hydrate into the gaseous state directly in the formation were listed. The three methods included (1) pumping of catalysts (e.g., methanol) into the formation, (2) artificially reducing formation pressure, and (3) increasing formation temperature by pumping water, steam, or hot gases into the deposit (the method showing the best economic prospects in many areas of Siberia which have abundant supplies of thermal waters). However, no details of the techniques were provided. And methanol or salt additions cool down, rather than heat, the deposits; and, in consequence, the methane recovery is delayed or limited. Furthermore, introducing any liquid into hydrates by conventional (as opposed to self-powered) pumping would be expensive, often prohibitively so.

Additionally, many others have addressed producing methane and other hydrocarbon gases which are dissolved in brine or water, as opposed to occurring as solids, particularly geopressured-geothermal (GPGT) brine which can be delivered to the surface by artesian forces, thereby permitting above-ground processing. However, the hot geothermal brines prevent the formation of the solid hydrates of hydrocarbons which are of interest in the present patent application. And the methods of recovering dissolved methane (particularly the economically promising methods involving pressure reduction) have little relationship to the present invention for recovering methane from solid hydrates.

Although it is well known in the art to melt solid sulfur in the Frasch process (as described, for example, by Linus Pauling in *College Chemistry,* W. H. Freeman and Co., 2nd Edition, 1957, on pages 299–300, wherein water superheated to above the sulfur melting point (about 119° C.) is pumped under pressure into the sulfur deposits), the Frasch process is not self-powered and the product recovered is a solid, not a gas. Additionally, pumping from the surface by conventional methods and devices is expensive.

Therefore, a need still exists for a substantially self-powered device and method for economically recovering hydrocarbons (including methane) from deposits of natural gas-containing hydrates which are solid formations or which contain substantially solid hydrates (e.g., in the form of a slush).

SUMMARY OF THE INVENTION

An object of this invention is a substantially self-powered method and apparatus for recovering hydrocarbons from naturally occurring (or non-naturally occurring, e.g., stored) solid hydrocarbon-containing hydrates.

Further objects of this invention are a method and apparatus for simply, efficiently, and economically recovering hydrocarbons from hydrostatically pressured formations containing the hydrocarbons.

Still further objects of this invention are a method and apparatus for producing hydrocarbons from hydrocarbon-containing hydrate formations located either under a body of land or under a body of water.

Still further objects of the invention are a method and apparatus for producing natural gas from solid hydrates which are intermixed with brine and/or solids (e.g., sand), using a method and apparatus which are substantially self-powering.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects, and in accordance with the purpose of the present invention, as embodied and broadly described herein, the method of this invention comprises:

recovering hydrocarbons from a formation comprising hydrocarbon hydrates by (a) inserting a first conduit means and at least a second conduit means at least into the formation; (b) starting a flow of relatively warm brine brought down from an upper level relative to the hydrates by use of an external applied pressure source temporarily applied to one of the conduit means; (c) then removing the applied pressure source and allowing the brine to circulate through the hydrates, thus melting them and producing gaseous hydrocarbons in a process which is substantially self-powered due to a difference in hydrostatic pressure in the conduit means; and (d) separating the produced hydrocarbons from a spent brine.

In a preferred embodiment, the gaseous hydrocarbons rise and the spent brine falls through separate parts of one of the conduit means in the separation step.

In one embodiment, two conduit means which are concentric pipes of two unequal diameters are used, with one pipe located within the other; and in another embodiment, two conduit means spaced apart are used. In yet another embodiment, more than two spaced apart conduit means are used.

In a further aspect of the present invention, in accordance with its objects and purposes, the apparatus of the invention comprises:

two conduit means to be inserted into a hydrate formation, a first conduit means located within a second conduit means and having a space therebetween, and two being connected by a connector which connects the top of the inner conduit means to a first orifice (which opens to the space external to the apparatus and which is located in the side of and near the top end of the outer conduit means), the outer conduit means being sealable at its top end and having a second orfice also located in the side of and near the top end of the outer conduit means.

In a still further aspect of the present invention in accordance with its objects and purposes, the apparatus of the invention comprises: a conduit means to be spaced apart from and operated in cooperation with at least one additional substantially similar conduit means and inserted into a permeable hydrate formation, the conduit means being open at its bottom end, being adjustably sealable at its top end, and having a downwardly projecting substantially hollow sidearm which is attached to the conduit means at an orifice located in the side of and near the top end of the conduit means.

By the practice of the invention, it is expected that gaseous hydrocarbons can be recovered from solid hydrocarbon-containing hydrate formations using very little external power, due to the self-powering mechanism employed in the method and apparatus of the invention. By use of the method and apparatus of the invention, the extensive resources of methane hydrates which are thought to be located in regions of the ocean subfloor and in Arctic regions such as Alaska, Canada, and Siberia should be recoverable simply, efficiently, and economically, as well as quite safely and without extensive damage to the environment. No high pressures need be used or applied. Additionally, if the conduit means are drilled down into hot, dry rock formations (as described below and shown in FIG. 2), the amount of water or brine required will be less than in other embodiments of the invention, due to the additional heat acquired from the hot, dry rock. And if the hydrates are in the form of a slush (i.e., solid hydrates intermixed with brine), the permeability of the formation will be high and a very efficient recovery of natural gas will result. Additionally, when multliple wells are used, it is expected that the efficiency of gas recovery will be enhanced.

BRIEF DESCRIPTON OF THE DRAWINGS

The accompanying drawings, which are incorporated in and form a part of the specification, illustrate various embodiments of the present invention and, together with the description, serve to explain the principles of the invention. In the drawings:

FIG. 1 is a schematic illustration in cross section of an embodiment of the apparatus of the invention, in which two concentric pipes of unequal diameters are inserted into a formation of solid hydrocarbon hydrates, illustrating the heating of the hydrates and the release of gaseous hydrocarbons by self-powered circulating of warm ocean brine or other near-surface water into solid hydrate-containing formations.

FIG. 2 is a schematic illustration in cross-section of an embodiment of the apparatus of the invention which has been inserted at its lower end down into a hot, dry rock formation located below a hydrate-containing formation, showing heating of the hydrates and releasing of natural gas by self-powered circulation of brine brought down from upper elevations into the hot, lower formations.

FIG. 3 is a schematic illustration in cross section of an embodiment of the apparatus of the invention wherein two wells have been drilled into and through a formation made of solid hydrate and frozen sand and wherein the two wells continue down into a lower formation made up of liquid brine, solid hydrate, and sand. FIG. 3 illustrates how multiple wells can be used to improve circulation of the warm brine and melting of the hydrate.

DESCRIPTION OF THE PREFERRED EMBODIMENTS

In the following, self-powered is defined to mean without the use of moving mechanical or other external pumping devices.

In the following, the term hydrocarbons can include deposits of one or more types of hydrocarbons and mixtures of hydrocarbons and other gases (e.g., natural gas). Upon melting some gas must be produced in order to obtain the self-powering. However, at least some of the hydrocarbons can be a liquid; and they, too, can be recovered by any suitable step for separating them from the brine.

In all embodiments of the invention, at least one well is drilled into (and sometimes through) a formation containing hydrocarbon hydrates, and water which is at least somewhat warmer than the hydrates is brought down to the formation from an upper level through a conduit of the apparatus of the invention; and the apparatus becomes essentially self-powered after startup due to the difference in pressure between that in a bubbly column of brine (the spent brine outlet) and that in an essentially bubble-free column of brine (the fresh brine inlet). The wellhead can be on solid ground, over a body of water, or partially submerged in a body of water. Thus, the method and apparatus of the invention are not restricted to the ocean-floor embodiment described below.

Figure 1:
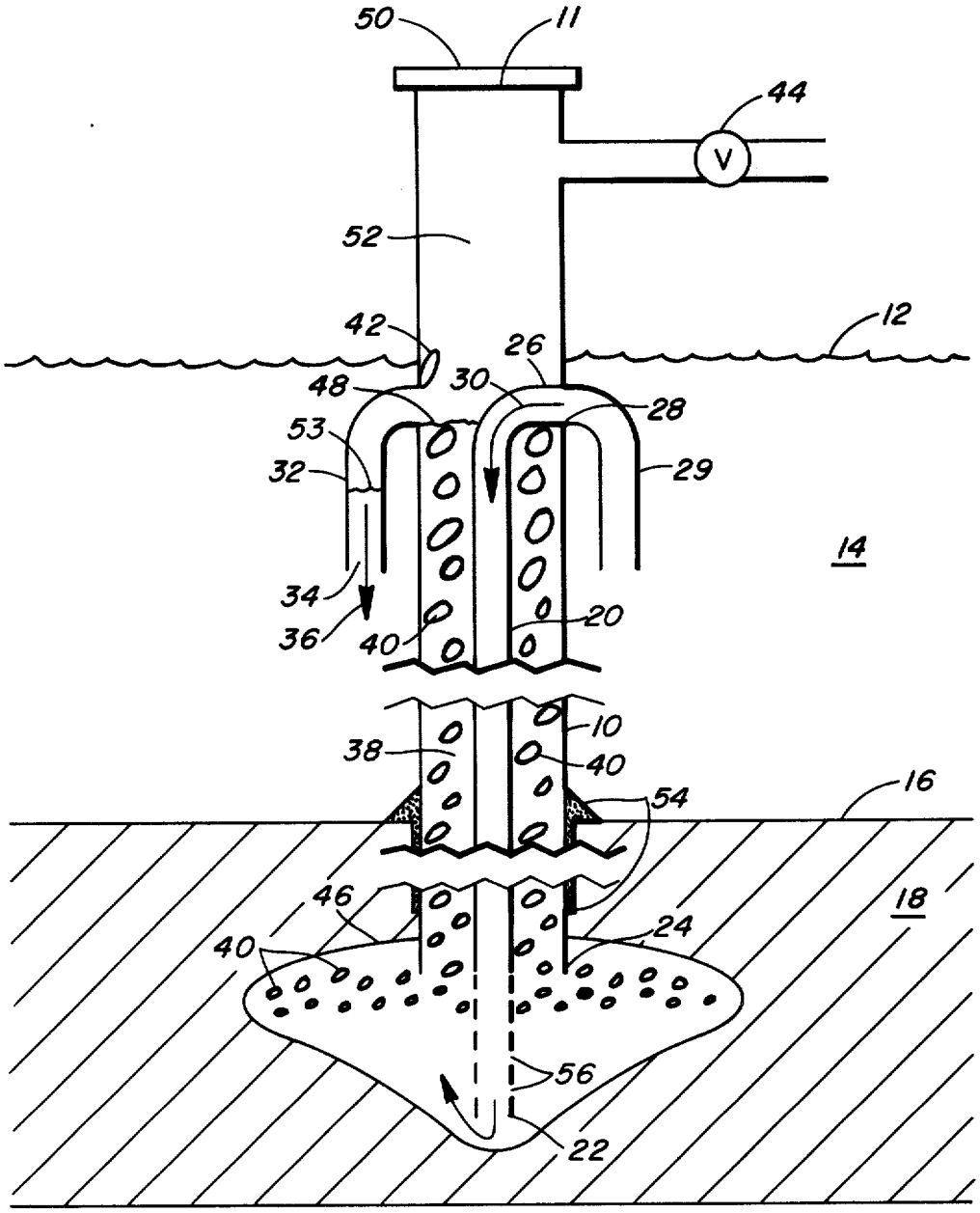

Referring to the drawing, in FIG. 1 a wellpipe 10 (e.g., 6 inches to 24 inches), having its upper end 11 located above the ocean surface 12, passes through the ocean 14 and penetrates the ocean floor 16. Its bottom end 24 enters a deposit of hydrocarbon hydrate 18 in the form of frozen mud. A standpipe 20 is placed into the well so that its bottom end 22 is at a depth greater than the depth at which the bottom end 24 of wellpipe 10 is located. The standpipe 20 is attached to the wellpipe 10 by a connector 26; and standpipe 20 fills from a hole 28 in wellpipe 10, through which warm, surface brine 30 (e.g., at 10° to 20° C. ) can enter the system. In addition, there is a side pipe (or sidearm) 32 attached to the wellpipe 10 and having a hole 34 through which used brine 36 is discharged near the ocean surface 12. Warm brine 30 enters hole 28 via optional sidearm 29 in wellpipe 10 and is circulated into the colder hydrate formation 18 (e.g., at 0° C.), being driven after startup (described below) by a hydrostatic head pressure resulting from the difference in column pressure exerted by the substantially bubble-free, warm brine 30 in standpipe 20 vs. the lower column pressure exerted by a bubbly column of used brine located in the annular region 38 located between standpipe 20 and wellpipe 10. The bubbles 40 result from release of gaseous hydrocarbons from the hydrocarbon hydrate formation 18 located below.

Circulation of brine 30 can be started by plugging side pipe 32 with a plug 42, which can be operated by any suitable means (for example, by an actuating means such as a solenoid) to temporarily seal side pipe 32. Then methane or other gas can be pumped down wellpipe 10 by use of a pump (not shown but which can be temporarily attached, e.g., at valve 44) to displace the brine in wellpipe 10. When the external applied pressure is released (e.g., through valve 44) and the plug 42 in side pipe 32 is raised or removed, the warm, surface brine 30 starts to circulate in at hole 28, down the standpipe 20, out end 22 to the hydrocarbon hydrate formation 18, where the brine melts hydrate and releases gaseous hydrocarbons (thus forming bubbles 40 and melting a dome 46 in the frozen mud made from the hydrocarbon hydrate and sedimentary material), then up the annular region 38 between the wellpipe 10 and the standpipe 20, and finally out of hole 34 in side pipe 32 and into the ocean 14. The bubbles 40 increase in size as they move up the annular region 38, thereby displacing more and more liquid from the brine column and generating a steady state condition in which the pressure exerted by the brine in the annular space 38 is less than the pressure exerted by the brine in the standpipe 20. The pressure difference circulates the brine; and, thereby, the release of gaseous hydrocarbons from the hydrocarbon hydrate formation provides self-powered circulation through which the gas-release process continues. Annular region 38 is sealed at one portion by connector 26 but is open along the remainder of its circumference. In the drawing, the top level 48 of the brine in annular space 38 is shown.

Access to the side pipe 32 (needed, for example, if it is to be plugged manually) is provided through a cap 50 on wellpipe 10. Product hydrocarbon gas 52 is released through valve 44. The length of side pipe 32 is sufficient to retain a brine level 53 in the side pipe and prevent the escape of product gas 52 out the bottom of the side pipe. This sidearm is preferred because it avoids bringing brine to the surface.

Preferably, wellpipe 10 is cemented with cement 54 or other suitable material above and into the hydrocarbon hydrate formation 18, in order to prevent gas leakage along the wellpipe 10; and the standpipe 20 can be insulated at depths which are in contact with the hydrocarbon hydrate region, if desired. The nature of melting within a hydrate formation using the apparatus of the invention is such that much of the warm brine attack is toward the bottom of the formation, leaving the solid dome of frozen hydrate 46 largely unchanged. Since preserving the solid dome 46 is preferred, and since heat exchange between flowing brines should be minimized, preferably the standpipe 20 will be insulated.

Alternately, instead of the procedure described above for startup, brine can initially be pumped in at hole 28 by a pump (not shown) so that it begins to flow out hole 34. Thereafter, the pump can be removed and the flow of brine will continue (as described above), with product hydrocarbon gas 52 being collected at valve 44. Alternatively, any external applied pressure source which can be temporarily applied can be used.

There is no reason to doubt the technical feasibility of the method and apparatus of the invention (including the embodiments described below), provided that the permeability of the hydrate formation is such that the brine can be made to flow at startup through the hydrocarbon hydrate formation 18. Any suitable means for facilitating (if necessary) this initial flow of brine can be used. A suitable way to achieve this flow, for example, is to use a standpipe having perforations 56 near its bottom end 22, through which warm brine will spray or flow. Another suitable method to achieve this goal is to drill through the hydrocarbon hydrate formation 18, then hydrofracture the formation, so as to produce some cracks through which the warm brine 30 can penetrate the formation. Alternatively, if desired, the bottom 24 of wellpipe 10 and the bottom 22 of standpipe 20 can be initially at substantially the same depth; and the bottom end 22 of standpipe 20 can be lowered (e.g., by using a lengthening pipe) as melting of the hydrocarbon hydrate formation 18 progresses. Another suitable alternative is to use an electrical current and employ resistance heating (e.g., through the electrically conductive brine) at startup. Any suitable way to accomplish the flow of the brine at startup is within the scope of this invention.

Figure 2:
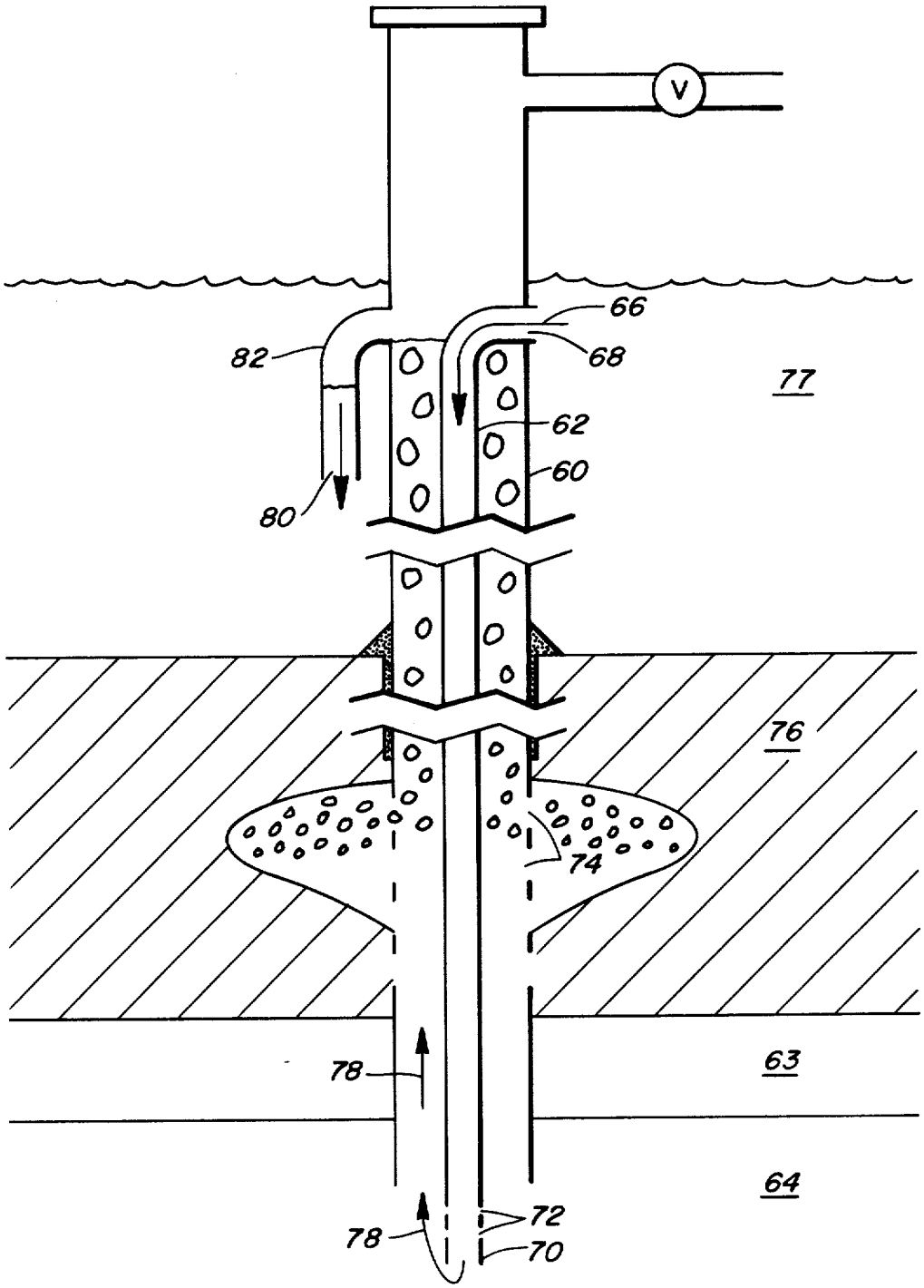

In FIG. 2, the wellpipe 60 and the standpipe 62 are shown extending into a hot dry rock region 64 (which can be alternatively any type of geothermal region)

through which the incoming, brine 66 (which entered the system via hole 68) can be circulated by any suitable means after it leaves the bottom end 70 of standpipe 62. Near the bottom end 70 of standpipe 62 are shown perforations 72 in standpipe 62 which improve the flow of incoming warm brine 66 in hot, dry rock region 64. Large perforations 74 in wellpipe 60 at depths adjacent to the hydrocarbon hydrate formation 76 under ocean 77 allow the hot brine 78 to circulate out of the wellpipe 60, through the hydrocarbon hydrate formation 76, back into the wellpipe 60, and out hole 80 in the side pipe 82. In this embodiment, the brine which melts the hydrocarbon hydrate formation is much hotter than is surface brine; hence, less fluid will need to be circulated, wellpipe insulation will be unnecessary and gas recovery will be more rapid than in the situation described above and illustrated in FIG. 1. Region 64 can be briny or hydrofractured.

Figure 3:
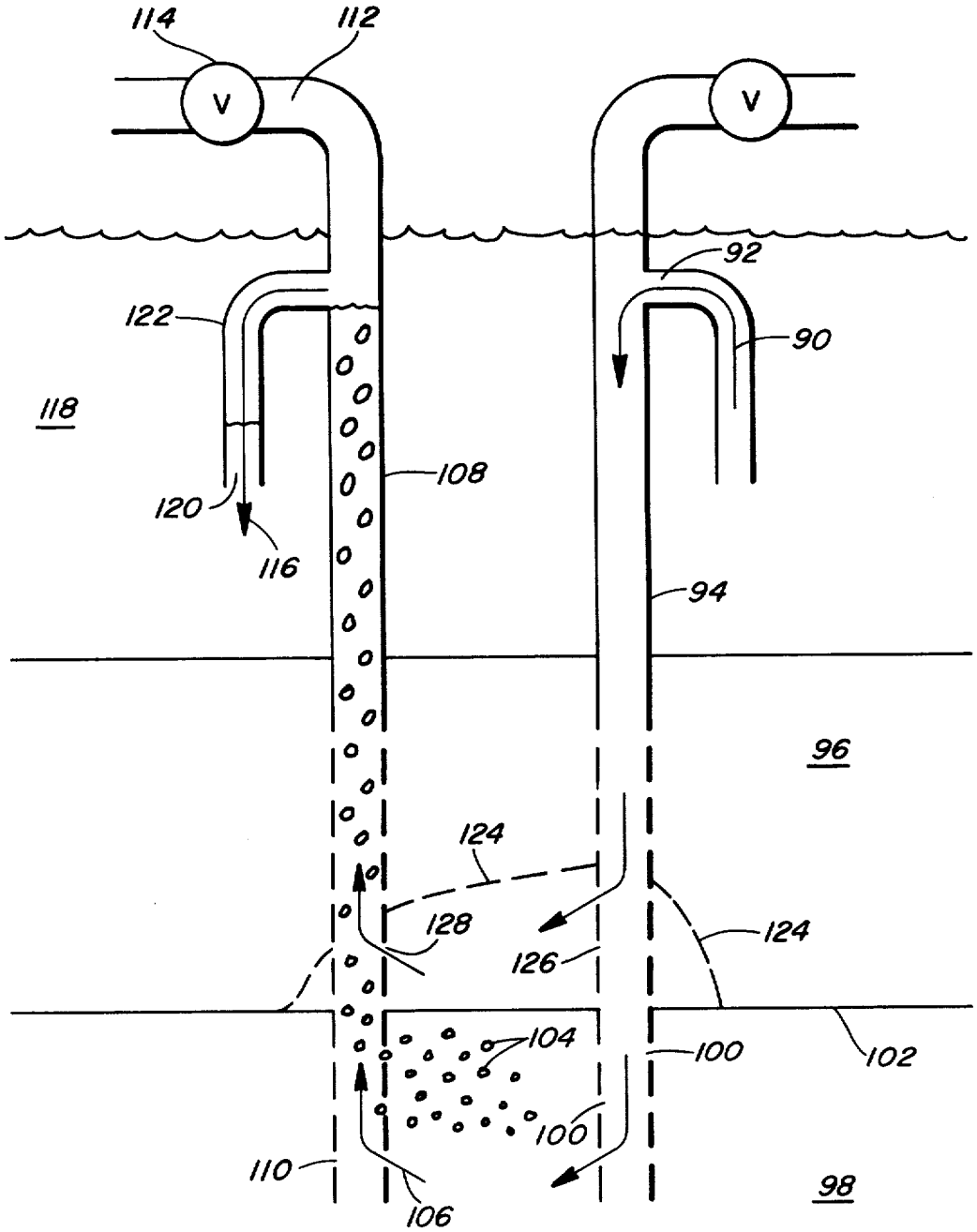

In FIG. 3, an embodiment is illustrated in which the melting of the hydrocarbon hydrate by warm brine is accomplished by use of two wells. (Alternatively, two branches of a single well can be formed by directional drilling). In this embodiment, warm brine 90 moves through hole 92 into the first wellpipe 94 (which is preferably insulated), down into a region 96 of solid hydrate and other solids (e.g., frozen sand) then into a second region 98 containing liquid brine and solid hydrate, along with other solids. The warm brine 90 moves out of the first wellpipe 94 through its perforations 100, flows along (but under) the bottom 102 of the solid hydrate formation 96, thus heating the region 98 and forming small bubbles 104 of gaseous hydrocarbons. The bubbles 104 are carried along with the brine 106 which flows into the second wellpipe 108 through perforations 110. As the brine rises in the second wellpipe 108 the bubbles 104 expand, thereby creating more and more displacement of brine in the wellpipe 108 and consequently a greater gas lift. The product gaseous hydrocarbons 112 is released through valve 114 and collected; and cooled brine 116 moves out to the ocean 118 via the hole 120 in side pipe 122.

Melting of the solid hydrate in the second region 98 eats into the bottom 102 of the formation 124, thereby altering the formation configuration and replacing part of the solid by liquid. The flow path for the warm brine has been altered to pass out of passages 126 of the first wellpipe 94 and into passages 128 of the second wellpipe 108, at a higher elevation than that of the original flow path in the second region 98.

In this embodiment, the natural gas bubbles are small at the high pressures of the ocean subfloor 102, and they move fairly readily along with the flowing brine. However, as the formation 124 gets steeper, it becomes harder for the brine to carry the natural gas bubbles. Therefore, to correct for this problem, the roles of the two wellpipes are periodically changed; and the direction of the brine flow is reversed to keep the bottom of the eroded hydrocarbon hydrate formation fairly level.

Where the first wellpipe 94 or the second wellpipe 108 or both are placed so that they penetrate into a region containing mixed brine and hydrocarbon hydrates as a slush (with or without sand being present), the circulation of brine will tend to move the slush into the product outlet wellpipe. This form of circulation will be very useful because it will move the slush into warmer ocean regions where the solid will melt and efficiently deliver gaseous product to the surface for recovery. If sand is present, it can be removed by any suitable means before it enters wellpipe 108 although such removal may not be necessary.

Additionally, it is believed that using multiple wells will result in advantages in efficiently and quickly sweeping hydrocarbons from a formation.

If the hydrocarbon hydrate-containing formation also contains other materials which form gases upon melting, they can (if desired) be separated from the gaseous hydrocarbons by any suitable means.

The method and apparatus of the invention can also be used for producing other gases from gas-containing formations which can be melted with warm or hot brine according to the method and apparatus described above.

If surface water is used in the method of the invention, the water inlet and water outlet are both connected to the source of water (for example, a pond), thereby permitting recirculation of the water.

The well or wells penetrating at least into the hydrate formation can be drilled by any suitable method.

Any suitable means for separating the produced gas from spent brine can be used in the method of the invention. However, the sidearm (as shown in FIGS. 1, 2, and 3) is preferred because of its simplicity; separating devices (not shown) can be incorporated into the side arm if desired.

The foregoing description of preferred embodiments of the invention has been presented for purposes of illustration and description. It is not intended to be exhaustive or to limit the invention to the precise forms disclosed, and obviously many modifications and variations are possible in light of the above teaching. The embodiments were chosen and described in order to best explain the principles of the invention and their practical application to thereby enable others skilled in the art to best utilize the invention in various embodiments and with various modifications as are suited to the particular use contemplated. It is intended that the scope of the invention be defined by the claims appended hereto.

What is claimed is:

1. A substantially self-powered method of recovering at least gaseous hydrocarbons from a formation comprising solid hydrocarbon hydrates, said method comprising:

(a) inserting at least two conduit means at least into said formation, such that brine can flow between a first conduit means and at least a second conduit means;

(b) starting a flow of relatively warm brine brought down from an upper level relative to said hydrates through said first conduit means by applying an external applied pressure source to said first conduit means or said second conduit means;

(c) discontinuing said applied pressure source and allowing said relatively warm brine to contact and melt said hydrates, wherein said brine moves after startup due to a difference in the hydrostatic pressure in said first conduit means containing essentially bubble-free brine and the hydrostatic pressure in said second conduit means containing at least both upwardly moving spent brine and bubbles of gaseous hydrocarbons produced when said hydrates melt; and (d) separating said produced gaseous hydrocarbons from said spent brine.

2. A method according to claim 1, wherein said produced gaseous hydrocarbons are separated from said spent brine by a separating means located within said second conduit means and including also the step of recovering said gaseous hydrocarbons.

3. A method according to claim 2, wherein said produced gaseous hydrocarbons are separated from said spent brine by allowing said gaseous hydrocarbons to rise through said second conduit means and by allowing said spent brine to fall through an opening in said second conduit means.

4. A method according to claim 3, wherein said first conduit means and said second conduit means are inserted no deeper than the bottom of said formation.

5. A method according to claim 3, wherein said first conduit means and said second conduit means are inserted into and through said hydrate formation.

6. A method according to claim 4 or 5, wherein said first conduit means and said second conduit means are concentric pipes of unequal diameters and wherein said first conduit means is located within said second conduit means.

7. A method according to claim 4 or 5, wherein said first conduit means and said second conduit means are pipes and are spaced apart.

8. A method according to claim 7, wherein said first conduit means and said second conduit means are inserted into a region containing slush of hydrocarbon hydrates.

9. A method according to claim 5, wherein the bottom ends of said first conduit means and said second conduit means are inserted into a region containing hot, dry rock and wherein said second conduit means has perforations in the portion thereof located adjacent to said hydrate formation.

10. A method according to claim 3, wherein said hydrocarbon hydrates are located below a body of water and wherein said spent brine comprises also liquid hydrocarbons and including also the steps of separating said liquid hydrocarbons from said spent brine and recovering said liquid hydrocarbons.

11. A method according to claim 3, wherein said hydrates are located below a body of land and wherein said spent brine comprises also liquid hydrocarbons and including also the steps of separating said liquid hydrocarbons from said spent brine and recovering said liquid hydrocarbons.

12. A method according to claim 3, wherein said hydrocarbon hydrates are located below a body of water.

13. A method according to claim 3, wherein said hydrates are located below a body of land.

* * * * *